US006221032B1

(12) United States Patent
Blanchard et al.

(10) Patent No.: US 6,221,032 B1
(45) **Date of Patent: *Apr. 24, 2001**

(54) CONTINUOUS PASSIVE MOTION DEVICE HAVING A REHABILITATION ENHANCING MODE OF OPERATION

(75) Inventors: Frederick W. Blanchard, Portage, MI (US); Stephen L. Brown, Chattanooga, TN (US); Dwayne Hofstatter, Woodstock, GA (US); D. Chris Linville, Hixson, TN (US); Jeffrey K. Pohl, Chattanooga, TN (US); James R. Vetter, Jr., Soddy Daisy, TN (US)

(73) Assignee: Chattanooga Group, Inc., Hixson, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/436,639

(22) Filed: Nov. 9, 1999

(51) Int. Cl.[7] ..... A61H 1/00
(52) U.S. Cl. ..... 601/34; 601/23
(58) Field of Search ..... 601/23–35; 606/240–244

(56) References Cited

U.S. PATENT DOCUMENTS

| | | | |
|---|---|---|---|
| 4,487,199 | | 12/1984 | Saringer . |
| 4,492,222 | | 1/1985 | Hajianpour . |
| 4,520,827 | | 6/1985 | Wright et al. . |
| 4,549,534 | | 10/1985 | Zagorski et al. . |
| 4,558,692 | | 12/1985 | Greiner . |
| 4,566,440 | | 1/1986 | Berner et al. . |
| 4,602,618 | | 7/1986 | Berze . |
| 4,603,687 | | 8/1986 | Greenwood . |
| 4,621,620 | * | 11/1986 | Anderson ..... 601/34 |
| 4,637,379 | | 1/1987 | Saringer . |
| 4,665,899 | | 5/1987 | Farris et al. . |
| 4,671,257 | | 6/1987 | Kaiser et al. . |
| 4,798,197 | | 1/1989 | Nippoldt et al. . |
| 4,807,601 | | 2/1989 | Wright . |
| 4,825,852 | | 5/1989 | Genovese et al. . |
| 4,834,073 | | 5/1989 | Bledsoe et al. . |
| 4,930,497 | | 6/1990 | Saringer . |
| 5,228,432 | | 7/1993 | Kaiser et al. . |

(List continued on next page.)

OTHER PUBLICATIONS

Advertisement for Breg Flex–Mate K500, 1997.

*Primary Examiner*—Justine R. Yu
(74) *Attorney, Agent, or Firm*—Chambliss, Bahner & Stophel, P.C.

(57) ABSTRACT

A continuous passive motion device which may be used in providing physical therapy for a patient's knee by moving the patient's leg through a plurality of cycles of motion in a treatment session includes an "Oscillation Zone" range of motion feature that permits the machine to be operated in such a manner that the patient's knee is flexed and his leg extended through a critical or working range of motion more frequently than through the non-critical range of motion, or the remainder of the range of motion of the device, so as to increase the portion of time of a treatment session that is spent in the working range of motion. A preferred embodiment of the device allows the patient's knee to be flexed, extended and held in certain positions a predetermined number of times per cycle, so as to provide a treatment regimen which replicates the holding and stretching one might receive through physical therapy conducted by a therapist or a physician. A preferred embodiment of the invention also has "Soft Turns" capability, wherein the carriage holding the patient's leg is decelerated, at a controlled rate over a controlled distance, from the operational speed to zero, as the carriage approaches an extension or flexion limit, and wherein the carriage is accelerated in the same fashion as the carriage moves away from the extension or flexion limit.

20 Claims, 5 Drawing Sheets

U.S. PATENT DOCUMENTS

| | | | | |
|---|---|---|---|---|
| 5,239,987 | | 8/1993 | Kaiser et al. . | |
| 5,252,102 | | 10/1993 | Singer et al. . | |
| 5,255,188 | | 10/1993 | Telepko . | |
| 5,273,520 | * | 12/1993 | Rebmann | 601/34 |
| 5,277,681 | * | 1/1994 | Holt | 482/112 |
| 5,280,783 | | 1/1994 | Focht et al. . | |
| 5,303,716 | | 4/1994 | Mason et al. . | |
| 5,399,147 | | 3/1995 | Kaiser . | |
| 5,452,205 | | 9/1995 | Telepko . | |
| 5,509,894 | | 4/1996 | Mason et al. . | |
| 5,682,327 | | 10/1997 | Telepko . | |

* cited by examiner

CONTINUOUS PASSIVE MOTION DEVICE HAVING A REHABILITATION ENHANCING MODE OF OPERATION

FIELD OF THE INVENTION

The present invention relates generally to medical rehabilitation devices, and more particularly to a device which may be used to flex the knee joint of a patient as part of a therapeutic or rehabilitative program.

BACKGROUND OF THE INVENTION

Knee injuries are an unfortunate byproduct of today's emphasis on sports and physical fitness; however, effective surgical techniques have been developed to repair injuries such as to the anterior cruciate ligament (ACL) and other components of the knee. In addition, many members of our aging population are candidates for total knee replacement surgery because of disease and/or injury. All of these surgical procedures must be followed by a period of rehabilitation in order for recovery to be complete. Furthermore, some injuries to the knee may not require surgery but instead may require an extensive rehabilitation period. Such rehabilitation generally requires that the knee be flexed and the leg be extended such as occurs in normal walking; however, it is frequently undesirable for a recovering patient to bear weight on his leg while rehabilitating his knee. In addition, when a knee has suffered a trauma or other injury, or after surgery, a person often lacks the necessary muscle control, strength or will to flex his knee and straighten his leg. Consequently, there is a need for a rehabilitation device that can be used to mobilize the joint over a period of time as a part of the orthopedic care which follows an injury, illness or surgical procedure.

The therapeutic use of an external force to flex and extend the limb to induce motion is referred to as passive motion. The application of continuous passive motion to a joint following a period of immobilization, injury, surgery or the like, has been shown to reduce post-operative pain, decrease the number of adhesions, decrease the amount of atrophy experienced by the surrounding and supporting muscle, promote the speed of recovery, improve the range of motion in a much shorter time, and reduce the risk of deep vein thrombosis and post-traumatic osteopenia. Depending on the nature and severity of the knee injury or the nature and extent of the surgical procedure performed, therapeutic treatment sessions involving continuous passive motion may be carried out on a daily basis for several days or several weeks.

The concept of a therapeutic use of passive and continuous motion is not new, as evidenced by a number of known devices that are designed to impose continuous passive motion on the limb and joint of a patient for such purpose. For example, U.S. Pat. No. 4,492,222 of Hajianpour describes a knee exerciser comprised of a leg support that is hinged at one end to a thigh support and is fixed at its other end to a motor assembly. The other end of the thigh support is pivotally attached to a frame, and the motor assembly is also pivotally attached to the frame. A screw that is threaded into a tubular portion of the leg support is rotated by the motor to drive the device. The Hajianpour device also includes an up/down counter that is arranged to count revolutions of the motor drive shaft via a magnetic sensor. When the count of the counter reaches either the flexion or extension limits, the direction of rotation of the motor is changed.

U.S. Pat. No. 4,558,692 of Greiner describes a motor driven leg exerciser having an adjustable leg support, a movable footrest, a motor, and controls for the user or therapist. In operation, the motor drives a chain driven rod back and forth in an arc to move the leg support. As the rod reaches each end of its arc, it activates a directional switch which in turn stops the motor, causes the device to pause for a predetermined period of time, and reverses the direction of the rod. The arcuate movement of the rod causes the leg support to move the patient's leg from an extended position to a bent position.

As the use of therapeutic continuous passive motion (CPM) machines has increased, so too have the number of developments and improvements in the related technology. For example, U.S. Pat. No. 4,798,197 of Nippoldt et al. and U.S. Pat. No. 4,558,692 of Greiner describe various safety features which, upon the occurrence of any of several conditions, will cause the carriage holding the leg to stop and reverse direction; U.S. Pat. No. 4,825,852 of Genovese et al. describes hinges between the upper and lower members of the leg support which are designed to better mimic the motion of the knee joint and thereby increase patient comfort; U.S. Pat. No. 5,255,188 and No. 5,452,205, both of Telepko, describe a universal controller for a CPM device which includes a clock and a liquid crystal display for displaying the accumulated running time for an exercise session; U.S. Pat. No. 5,682,327 of Telepko describes a direct drive CPM device which maintains an approximately constant angular velocity at the knee so as to increase the comfort level of the patient, and U.S. Pat. No. 4,665,899 of Farris et al. describes a CPM device having control means which allows the user or a therapist to change the degree of extension and flexion of the leg, and also having a repetition counter that can count and display the number of flexion repetitions completed. Furthermore, U.S. Pat. No. 4,566,440 of Berner, et al. and U.S. Pat. No. 5,682,327 of Telepko describe continuous passive motion devices which pivot the patient's leg about a virtual axis that is coincident with the hip pivot axis. This helps to avoid placing unnecessary strain on the patient's leg or hip joint, and increases the comfort of the patient as treatment is carried out. U.S. Pat. No. 5,452,205 and No. 5,682,327, both of Telepko, describe a dynamic tension mode of treatment in which a continuous constant force is applied to the joint under treatment for a predetermined period of time in order to extend the range of motion of the joint. The constant force is applied in one direction for a predetermined period of time or until a predetermined limit is reached. A constant force is then applied in the opposite direction. This sequence of motion and tensioning is designed to minimize patient fatigue. U.S. Pat. No. 5,252,102 of Singer et al. describes an electronic range of motion apparatus which is adaptable for use with a prosthesis or a CPM machine and which gradually increases the patient's flexion and extension ability with gentle stretching utilizing a self-programmable feature and multiple range options. U.S. Pat. No. 4,520,827 of Wright et al., describes a CPM device which pauses each time the extension end position is reached so that a neuromuscular stimulator may be activated to stimulate the quadriceps of the patient. A control unit monitors the position of the CPM carriage and provides a pause in the drive signal to the motor when the extension end position of the CPM carriage is reached. At the end of the pause interval, the neuromuscular stimulator is turned off and motion of the carriage is resumed. Finally, U.S. Pat. No. 5,682,327 of Telepko describes a "warm-up" mode of operation by which the range of motion of the device is automatically and gradually increased over a preset period of time at the beginning of a treatment session. U.S. Pat. No. 4,825,852 of Genovese et al. describes a similar "warm-up"

feature by which the programmed force and range of motion is automatically reduced somewhat when exercise is restarted after a rest period.

Despite these improvements in CPM technology, conventional CPM devices suffer from several disadvantages. Among these is the fact that conventional CPM machines generally require regular intervention on the part of a therapist or physician as the treatment progresses. For example, even though a patient is using a CPM device which is flexing his knee and extending his leg, conventional CPM machines do not include a treatment regimen which provides for or replicates the additional holding and stretching one might receive through active physical therapy with a therapist or a physician. Such additional flexing, stretching, and holding at certain points within the critical or working range of motion may increase the rate of rehabilitation; however, the cost of therapist- or physician-aided physical therapy is often quite high. Furthermore, in order to obtain the benefits of therapist- or physician-aided therapy, the patient will typically be required to travel to a hospital or other institutional location. Therefore, such rehabilitation is costly and inconvenient. It would be desirable, therefore, if a continuous passive motion device could be developed that would provide a patient the benefits of therapist- or physician-aided physical therapy without requiring the presence or assistance of a therapist or physician.

The inventors of the present invention have learned that therapeutic benefits may be obtained if a greater portion of the treatment time is spent in flexion (or extension) within a critical portion of the range of motion near the flexion (or extension) limit. Therefore, it would also be desirable if a continuous passive motion device could be developed that would concentrate the time spent in a treatment session in flexing the patient's knee or extending his leg through the critical or working portion of the range of motion. It would also be desirable if such a device could be developed that would be relatively simple for a patient to operate and therefore, more likely to be properly used.

Another disadvantage of the constant speed CPM machines is that the carriage holding the patient's leg is rapidly decelerated from the operational speed of the carriage to zero as the carriage reaches its operational extension or flexion limit, and rapidly accelerated from zero to the operational speed in the opposite direction as the carriage moves away from the limit. Such sudden speed and direction changes are uncomfortable for the patient and may impose undesirable stresses on his knee and leg. It would be desirable therefore, if a CPM device could be developed which would allow the carriage to make "Soft Turns" when changing directions.

ADVANTAGES OF THE INVENTION

Accordingly, the invention described and claimed herein provides among its advantages that a patient or therapist may establish a working range of motion, comprising only a portion of the operational range of motion, in which flexion and extension may be concentrated, by repeating the flexion and extension within the working range a desired number of times before carrying out flexion and extension throughout the entire operational range of motion. Another advantage of the invention described and claimed herein is that it allows a patient to spend more of his treatment time in the working portion of the operational range of motion, as compared to conventional CPM machines. Another advantage of a preferred embodiment of the invention is its "Soft Turns" capability, wherein the carriage holding the patient's leg is decelerated, at a controlled rate over a controlled distance, from the operational speed to zero, as the carriage approaches the extension or flexion limit, and wherein the carriage is accelerated in the same fashion as the carriage moves away from the extension or flexion limit.

Other advantages and features of this invention will become apparent from an examination of the drawings and the ensuing description.

EXPLANATION OF TECHNICAL TERMS

As used herein, the term range of motion refers to a range of angular motion between the lower leg support and the upper leg support of the invention. The term range of motion may also refer to the range of angular motion that is or may be imposed on a patient's knee by the invention, as measured by the change in the angle between the tibia and the femur of the patient's leg.

As used herein, the term flexion refers to that portion of a range of motion in which the angle between the lower leg support and the upper leg support of the invention, or the angle between the tibia and the femur of the patient's leg, is decreasing.

As used herein, the term flexion phase refers to that portion or phase of the operation of the invention during which flexion occurs.

As used herein, the term extension refers to that portion of a range of motion in which the angle between the lower leg support and the upper leg support of the invention, or the angle between tibia and the femur of the patient's leg, is increasing.

As used herein, the term extension phase refers to that portion or phase of the operation of the invention during which extension occurs.

As used herein, the term flexion limit refers to a limit that may be imposed during flexion on the angle between the lower leg support and the upper leg support of the invention, or on the angle between the tibia and the femur of the patient's leg. The term flexion limit also refers to a point along the axis of the frame of a preferred embodiment of the invention to which, but not beyond which, the driver may be moved by operation of the motor during a flexion phase. When the driver reaches the flexion limit, the direction of motion of the driver along the axis of the frame will change and extension will begin.

As used herein, the term extension limit refers to a limit to extension that may be imposed on the angle between the lower leg support and the upper leg support of the invention, or on the angle between the tibia and the femur of the patient's leg. The term extension limit also refers to a point along the axis of the frame of a preferred embodiment of the invention to which, but not beyond which, the driver may be moved by operation of the motor during an extension phase. When the driver reaches an extension limit, the direction of motion of the driver along the axis of the frame will change and flexion will begin. An extension limit of greater than 180° may be referred to as hyperextension.

As used herein, the term limit may refer to either an extension limit or a flexion limit, depending on the context.

As used herein, the term flexion angle refers to the angle between the lower leg support and the upper leg support of the invention at a point during a flexion phase or at a particular flexion limit.

As used herein, the term extension angle refers to the angle between the lower leg support and the upper leg support of the invention at a point during an extension phase or at a particular extension limit.

As used herein, the term cycle refers to a continuous operation of the invention either from a flexion limit to an extension limit and back to a flexion limit, or from an extension limit to a flexion limit and back to an extension limit. The term cycle also refers to the movement of a patient's leg through a single flexion phase and a single extension phase.

As used herein, the term sub-cycle refers to a continuous operation of the invention from a flexion limit to an intermediate extension limit and back to a flexion limit or from an extension limit to an intermediate flexion limit and back to an extension limit.

As used herein, the term treatment time refers to the time during which the invention is operated continuously to move the patient's leg through a plurality of cycles, even though such operation may include one or more pauses in the motion imparted to the patient's leg.

As used herein, the term treatment session refers to a use of the invention for a treatment time.

As used herein, the term operational flexion limit refers to a flexion limit that is established for a selected range of motion. The operational flexion limit may be changed during a treatment session.

As used herein, the term operational extension limit refers to an extension limit that is established for a selected range of motion. The operational extension limit may be changed during a treatment session.

As used herein, the terms speed or rate of operation refer to the rate of change of the angle between the upper leg support and the lower leg support, as such supports pivot at the connection therebetween, per unit of time. As used herein in connection with the preferred embodiment, the terms speed or rate of operation may also refer to the rate at which the driver moves along the axis of the frame per unit of time, although such rate is typically expressed in terms of the rate of change of the angle between the upper leg support and the lower leg support.

As used herein, the term critical range of motion or working range of motion refers to that portion of the range of motion (typically, but not limited to, that portion of the range of motion near a flexion limit during the flexion phase and/or that portion of the range of motion near an extension limit during the extension phase) where therapeutic benefit is most likely to be obtained as a result of flexion or extension movements. As used herein, the critical range of motion or working range of motion refers to that portion of the range of motion between an intermediate flexion limit and the operational flexion limit in the flexion phase or between an intermediate extension limit and the operational extension limit in the extension phase.

As used herein, the term non-critical range of motion or non-working range of motion refers to that portion of the range of motion outside of the critical or working range of motion.

As used herein, the term oscillation zone refers to the portion of the range of motion between the operational flexion limit and an intermediate extension limit or between the operational extension limit and an intermediate flexion limit. The oscillation zone may be established such that its limits coincide with those of the critical range of motion or working range of motion, but the oscillation zone is not necessarily bound by the limits of the critical range of motion.

SUMMARY OF THE INVENTION

The invention comprises a therapeutic device for use in providing physical therapy for a patient's knee by moving the patient's leg through a plurality of cycles of motion in a treatment session. The device includes an "Oscillation Zone" range of motion feature that permits the machine to be operated in such a manner that the patient's knee is flexed and his leg extended through a critical or working range of motion more frequently than through the non-critical range of motion. The preferred embodiment of the invention further allows for holding the patient's leg for a desired time at the angle corresponding to a limit, so as to provide a treatment regimen which replicates the holding at a particular angular orientation that might be obtained during a physical therapy session conducted by a therapist or a physician.

The therapeutic device includes an elongated frame having an axis, a lower leg support which is adapted to support the lower leg of the patient, and an upper leg support which is adapted to support the upper leg of the patient. Each of the lower leg support and the upper leg support has a first end and a second end, and the first end of the upper leg support is pivotally connected to the first end of the lower leg support. The frame, lower leg support and upper leg support are interconnected in a manner such that both the tibia and the femur of the patient are generally coplanar with the axis of the frame. The device also includes means for repeatedly pivoting the lower leg support and the upper leg support at the connection therebetween so as to move the patient's leg through a plurality of cycles of motion, each of which imposes a range of motion on the patient's leg comprising a flexion phase, in which the angle between the lower leg support and the upper leg support is decreasing, and an extension phase, in which the angle between the lower leg support and the upper leg support is increasing. The device also includes means for setting a desired range of motion including an operational extension limit and an operational flexion limit. The operational extension limit corresponds to an operational extension angle between the upper leg support and the lower leg support to which the upper and lower leg supports may be pivoted during the extension phase of a cycle, and the operational flexion limit corresponds to an operational flexion angle between the upper leg support and the lower leg support to which the upper and lower leg supports may be pivoted during the flexion phase of a cycle. The device also includes means for setting at least one intermediate limit to the range of motion. The intermediate limit corresponds to an oscillation zone angle between the upper leg support and the lower leg support. The intermediate limit may be set as a flexion limit or an extension limit. If set as a flexion limit, the intermediate limit will correspond to an oscillation zone flexion angle between the upper leg support and the lower leg support that is greater than the operational flexion angle. If set as an extension limit, the intermediate extension limit will correspond to an oscillation zone extension angle which is less than the operational extension angle. The device also includes means for moving the extension limit from the operational extension limit to the intermediate extension limit and back to the operational extension limit, if the intermediate limit was set as an extension limit, or for moving the flexion limit from the operational flexion limit to the intermediate flexion limit, and back to the operational flexion limit, if the intermediate limit was set as a flexion limit. The device also includes means for setting a number of times that the upper leg support and the lower leg support may be pivoted from the operational flexion angle to the intermediate extension angle before the extension limit is moved from the intermediate extension limit to the operational extension limit, if the intermediate limit was set as an extension limit, or for setting a number of times that the upper leg support and the lower leg support may be pivoted from the operational extension angle to the intermediate flexion angle before the flexion limit is moved from the intermediate flexion limit to the operational flexion limit, if the intermediate limit was set as a flexion limit. The invention also includes means for counting the number of times that the upper leg support and the lower leg support are pivoted from the operational extension angle to the intermediate extension angle if the intermediate limit was set as an extension limit, or the number of times the upper leg support and the lower leg support are pivoted from the operational flexion angle to the intermediate flexion angle if the intermediate limit was set as a flexion limit.

Furthermore, the invention provides a method for providing physical therapy for a patient's knee by moving the patient's leg through a plurality of cycles of motion during a treatment session in a manner so that more time will be spent in the working range of motion.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to those skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
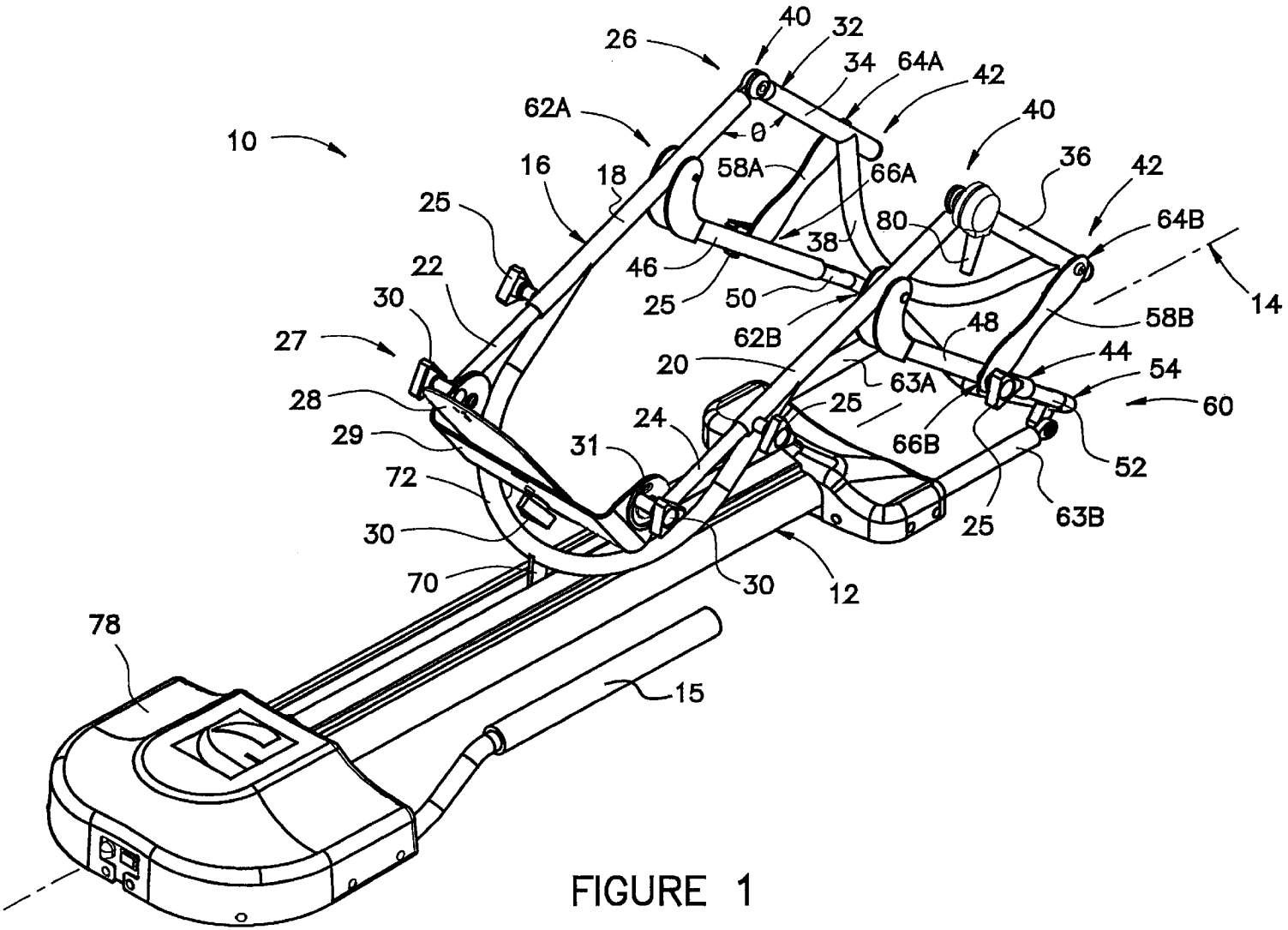
FIG. 1 is a front perspective view of the preferred embodiment of the therapeutic device.

Referring now to the drawings, preferred therapeutic device 10 operates by application of continuous passive motion to the knee joint of a patient during a treatment session that includes flexion of the knee and extension of the leg. Such motion is considered to be continuous or substantially continuous even though there will or may be pauses or stops at the flexion and extension limits, and perhaps at other times. Device 10 may be utilized in providing a regimen of physical therapy for a patient's knee by moving the patient's leg through a plurality of cycles of motion in each of a number of treatment sessions.

Figure 2:
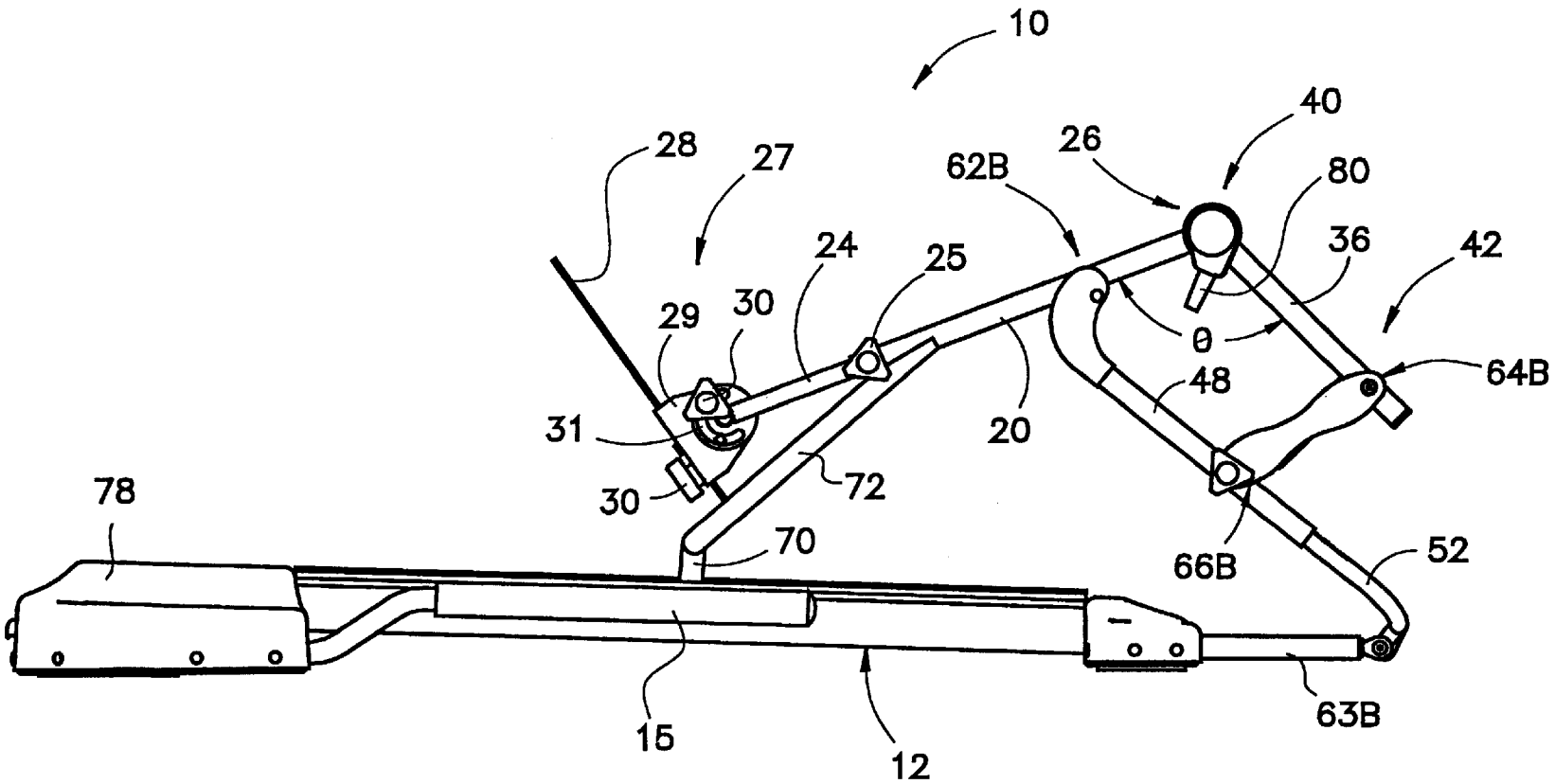
FIG. 2 is a side view of the device of FIG. 1.
Figure 3:
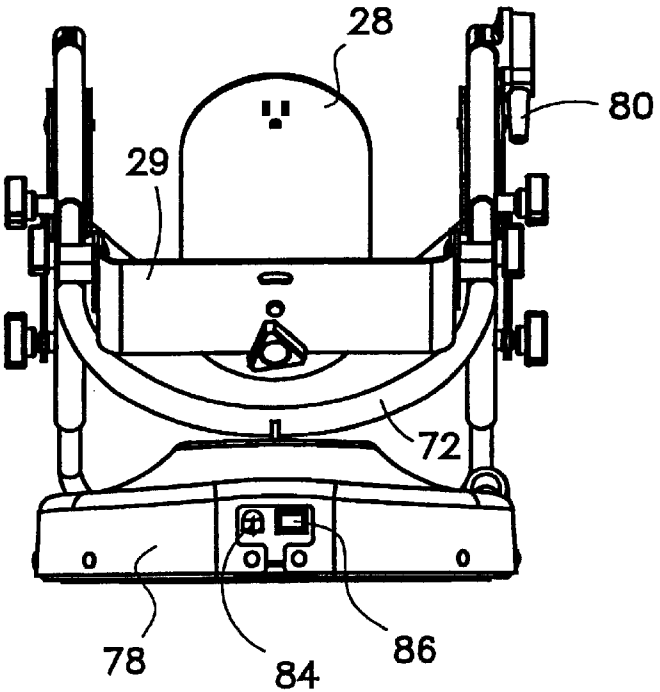
FIG. 3 is a front elevation view of the device of FIG. 1.
Figure 4:
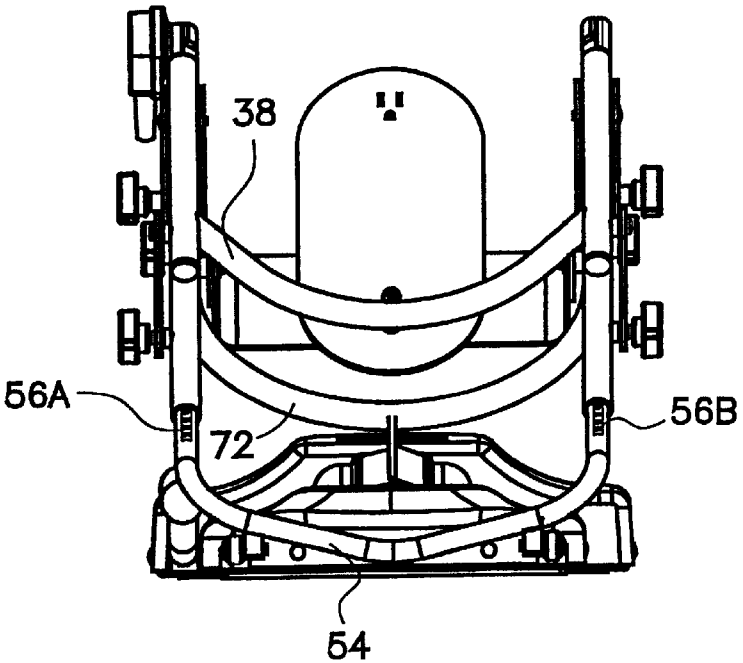
FIG. 4 is a rear elevation view of the device of FIG. 1.

Referring now to FIGS. 1 through 4, therapeutic device 10 includes elongated frame 12 having an axis 14 along its length. Preferably, the frame also includes carrying handle 15 which is located and balanced to provide easy portability of the machine. Device 10 also includes lower leg support 16 which is adapted to support the lower leg of the patient. Lower leg support 16 is preferably comprised of a pair of parallel tubular components 18 and 20 to which are attached a pair of telescoping end tubes 22 and 24, respectively. Each of the end tubes is adapted for sliding motion within the tubular component with which it is associated so as to permit adjustment of the length of the lower leg support to accommodate the lower leg length of the patient. Each of tubular components 18 and 20 is provided with a hole (not shown) through which a length adjusting bolt 25 may be placed in threaded engagement therewith. The adjusting bolt may then be advanced in the hole to bear against the surface of the end tube, and thereby to hold it securely in place. In the alternative, a length adjusting bolt 25 may be provided to engage with one of a series of holes (not shown) that are provided along the length of each of end tubes 22 and 24. By selecting the appropriate holes along the length of the end tubes for attachment to the tubular components, the length of the lower leg support may be adjusted. Lower leg support 16 has a first end designated generally at 26 near the knee of the patient and a second end designated generally at 27 adjacent to the patient's foot. Preferably, foot support 28 is mounted to the lower leg support through pivotally attached end plate 29. As shown in FIGS. 1 through 3, the foot support is attached to the end plate by means of bolt 30. The end plate is provided with an arc-shaped bolt hole 31 at each end into which a pair of bolts 30, fixed to the ends of tubes 22 and 24, may be placed for pivotal attachment to the lower leg support.

Device 10 also includes an upper leg support 32 which is adapted to support the upper leg of the patient. Upper leg support 32 of preferred device 10 includes an upper portion comprised of a pair of parallel tubular components 34 and 36 and a connecting cross support member 38. The upper leg support has a first end designated generally at 40 near the knee of the patient and a second end designated generally at 42 adjacent to the patient's hip. First end 40 of upper leg support 32 is pivotally connected to first end 26 of lower leg support 16.

The upper leg support of preferred therapeutic device 10 also includes U-shaped third support 44, which is comprised of a pair of parallel tubular components 46 and 48 to which are attached a pair of telescoping end tubes 50 and 52, respectively, of U-shaped end portion 54. Each of the end tubes is adapted for sliding motion within the tubular component with which it is associated so as to permit adjustment of the length of the upper leg support to accommodate the upper leg length of the patient. Each of tubular components 46 and 48 is provided with a hole (not shown) through which a length adjusting bolt 25 may be placed in threaded engagement therewith. The adjusting bolt may then be advanced in the hole to bear against the surface of the end tube, and thereby to hold it securely in place. In the alternative, a length adjusting bolt 25 may be provided to engage with one of a series of holes (not shown) that are provided along the length of each of end tubes 50 and 52. By selecting the appropriate holes along the length of the end tubes for attachment to the tubular components, the length of the upper leg support may be adjusted to accommodate the upper leg length of the patient. Scales 56A and 56B (see FIG. 4) are provided for convenience in adjusting the length of the upper leg support. The scales correspond to upper leg lengths for patients of different sizes. A patient's upper leg, from his hip to his knee, may be measured and components 50 and 52 slid into components 46 and 48 respectively until the ends of components 50 and 52 reach the patient's measured length on scales 56A and 56B. The third support has a first end 60 and a second end 62. First end 60 is pivotally attached to extensions 63A and 63B of frame 12, and second end 62 is pivotally attached to lower leg support 16 (second end 62A is attached to tubular component 18 and second end 62B is attached to tubular component 20).

Preferred upper leg support 32 also includes a pair of linkage members 58A and 58B (sometimes referred to herein collectively as linkage). The linkage members also have a first end 64 and a second end 66. First end 64A of linkage member 58A is pivotally attached to tubular component 34 of upper leg support 32 at or near second end 42, and second end 66A of linkage member 58A is pivotally attached to tubular component 46 of third support 44 (by means of a bolt 25) at a point intermediate between first end 60 and second end 62. Similarly, first end 64B of linkage member 58B is pivotally attached to tubular component 34 of upper leg support 32 at or near second end 42, and second end 66B of linkage member 58B is pivotally attached (by means of a bolt 25) to tubular component 48 of third support 44 at a point intermediate between first end 60 and second end 62.

Figure 5:
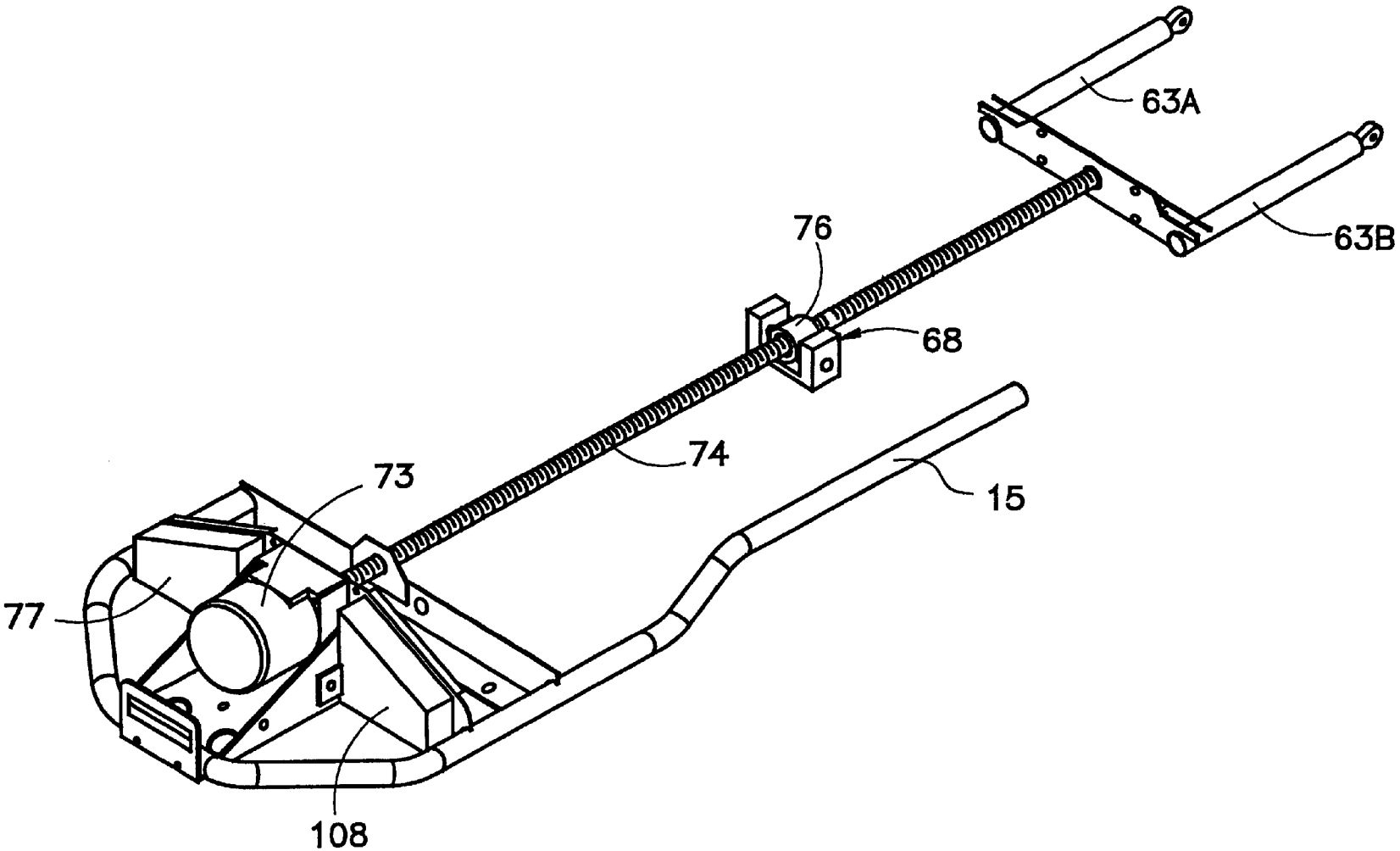
FIG. 5 is a partial front perspective view of the preferred embodiment of the invention, similar to FIG. 1 but showing details of the drive mechanism of the invention.

As has been mentioned, first end 26 of lower leg support 16 is pivotally attached to first end 40 of upper leg support 32. Device 10 is adapted to repeatedly pivot the lower leg support and the upper leg support at this connection so as to move the patient's leg through a plurality of cycles of motion, each of which imposes a range of motion on the patient's leg comprising a flexion phase in which the angle θ (see FIGS. 1 and 2) between the lower leg support and the upper leg support is decreasing, and an extension phase in which the angle 0 between the lower leg support and the upper leg support is increasing. The pivotal motion of the upper and lower leg supports is preferably obtained by the movement of driver 68 (see FIG. 5), which is attached to the second end of lower leg support 16 through upright attachment 70 and U-shaped tubular stabilizer 72. Preferably, the tubular stabilizer component of the lower leg support is welded to tubular components 18 and 20 and to upright attachment 70. The driver is adapted to move in both directions along the axis 14 of the frame by operation of motor 73 (see FIG. 5). Preferably, the motor is adapted to turn externally threaded drive rod 74 which is mounted in the frame and disposed along the axis of the frame, and driver 68 includes an internally threaded nut 76 that is adapted to mate with the drive rod. As shown in FIG. 5, nut 76 is mounted on the drive rod in threaded engagement therewith, so that the driver may be moved along the axis of the frame as the drive rod is turned by the motor.

In an alternative embodiment (not shown), the drive means of the invention may include a pulley and a cord mounted thereon, which cord is adapted to be moved along the axis of the frame by operation of the motor. In such embodiment, the driver is attached to the cord and is adapted to move along the axis of the frame as the cord is moved by operation of the motor. Still another embodiment (also not shown) of the drive means may be provided by a piston which is mounted in the frame and disposed along the axis thereof. In this embodiment, the piston has a piston rod that is adapted to be moved along the axis of the frame by operation of a pump, and the driver is attached to the piston rod and is adapted to move along the axis of the frame as the piston is operated by the pump.

By lying on his back at the rear of device 10 (to the right in FIGS. 1 and 2), a patient may place his leg in the device in proper supporting manner so that his upper leg is supported by support 32 and his lower leg is supported by support 16, with his knee located generally at the junction of first end 40 of upper leg support and first end 26 of lower leg support. As is apparent from an examination of the drawings, the frame, lower leg support and upper leg support are interconnected in a manner such that both the tibia (of the lower leg) and the femur (of the upper leg) of the patient are generally coplanar with the axis of the frame. Furthermore, because of the connection of the lower leg support to the driver, as illustrated in the drawings, movement of the driver in one direction along the axis will cause extension and movement of the driver in the opposite direction along the axis will cause flexion.

The invention includes a computer controller 77 such as is known generally to those having ordinary skill in the art to which the invention relates. This controller is mounted within housing 78, and wiring (not shown) is provided from the controller through the frame and through the various tubular components to control jack 80 (see FIG. 1). A control pendant 82 (see FIG. 6) is provided with a control cord (not shown) that is adapted to be plugged into the control jack to permit a therapist and/or the patient to access the controller. The combination of controller 77 and control pendant 82, connected through the control cord of the pendant and jack 80, provides means for controlling the various functions of the invention. The invention thus includes control means for setting a desired range of motion including an operational extension limit and an operational flexion limit. The operational extension limit corresponds to an operational extension angle Ooe between the upper leg support and the lower leg support to which the upper and lower leg supports may be pivoted during the extension phase of a cycle. In the embodiment of the invention that is illustrated in the drawings, the operational extension limit also corresponds to a point along the axis of the frame to which the driver may be moved during the extension phase by operation of the motor to establish an operational extension angle $\theta_{oe}$. The operational flexion limit corresponds to an operational flexion angle $\theta_{of}$ between the upper leg support and the lower leg support to which the upper and lower leg supports may be pivoted during the flexion phase of a cycle. In the embodiment of the invention that is illustrated in the drawings, the operational flexion limit also corresponds to a point along the axis of the frame to which the driver may be moved by operation of the motor during the flexion phase to establish an operational flexion angle $\theta_{of}$. Furthermore, the control means (comprising the combination of controller 77 and control pendant 82) for setting a desired range of motion in the illustrated embodiment includes limit switches or other means to insure that when the driver is moved by the operation of the motor to an extension limit, it will reverse direction and move towards the flexion limit. Similarly, when the driver is moved to a flexion limit, it will reverse direction and move towards the extension limit.

The upper leg support and the lower leg support may be referred to as the carriage, and the pivoting movement of the upper leg support and the lower leg support during a flexion phase may be referred to as moving the carriage towards the flexion limit. Similarly the pivoting movement of the upper leg support and the lower leg support during an extension phase may be referred to as moving the carriage towards the extension limit.

The invention provides an "Oscillation Zone" range of motion feature that permits the machine to be operated in such a manner that the patient's knee is flexed and his leg extended through an Oscillation Zone portion of the operational range of motion more frequently than through the remainder of the range of motion, so as to increase the portion of treatment time that is spent in the Oscillation Zone range of motion. A preferred embodiment of the invention also permits the patient's leg to be held at a limit to the range of motion for a desired period of time, so as to provide a treatment regimen which replicates the holding that a patient might receive through physical therapy conducted by a therapist or a physician.

As part of this feature, the invention also includes control means (comprised of the combination of controller 77 and control pendant 82) for setting an intermediate limit to the range of motion. The intermediate limit corresponds to an Oscillation Zone angle $\theta_{oz}$ between the upper leg support and the lower leg support, which angle will correspond, in the illustrated embodiment, to a point along the axis of the frame to which the driver may be moved by operation of the motor. The intermediate limit may be set as a flexion limit or an extension limit, but in either event, it will represent the beginning of the Oscillation Zone portion of the range of motion (which will preferably be the same as the critical or working portion of the range of motion). If the intermediate limit is set as a flexion limit, the intermediate limit will correspond to an Oscillation Zone flexion angle $\theta_{ozf}$ between the upper leg support and the lower leg support that is greater than the operational flexion angle and will define the Oscillation Zone portion of the range of motion between the Oscillation Zone flexion angle $\theta_{ozf}$ and the operational extension angle $\theta_{oe}$. If the intermediate limit is set as an extension limit, the intermediate extension limit will correspond to an Oscillation Zone extension angle $\theta_{oze}$ that is less than the operational extension angle and will define the Oscillation Zone portion of the range of motion between the Oscillation Zone extension angle $\theta_{oze}$ and the operational flexion angle $\theta_{of}$.

Control means (comprised of the combination of controller 77 and control pendant 82) are also provided for moving the extension limit from the operational extension limit to the intermediate extension limit and from the intermediate extension limit to the operational extension limit, if the intermediate limit is set as an extension limit. Control means (comprised of the combination of controller 77 and control pendant 82) are also provided for moving the flexion limit from the operational flexion limit to the intermediate flexion limit and from the intermediate flexion limit to the operational flexion limit, if the intermediate limit is set as a flexion limit.

The invention also includes control means (comprised of the combination of controller 77 and control pendant 82) for setting a number of times that the upper leg support and the lower leg support may be pivoted from the operational flexion angle to the intermediate extension angle before the extension limit is moved from the intermediate extension limit to the operational extension limit, if the intermediate limit is set as an extension limit, or for setting a number of times that the upper leg support and the lower leg support may be pivoted from the operational extension angle to the intermediate flexion angle before the flexion limit is moved from the intermediate flexion limit to the operational flexion limit, if the intermediate limit is set as a flexion limit. It is preferred that the number of times so set for pivoting from the operational angle to the intermediate angle before the appropriate limit is moved is three.

The invention also includes control means (comprised of the combination of controller 77 and control pendant 82) for counting the number of times that the upper leg support and the lower leg support are pivoted from the operational flexion angle to the intermediate extension angle if the intermediate limit is set as an extension limit, or for counting the number of times the upper leg support and the lower leg support are pivoted from the operational extension angle to the intermediate flexion angle if the intermediate limit is set as a flexion limit. After the set number of times is counted, the appropriate limit may be moved according to the invention.

The preferred embodiment of the invention also includes control means (comprised of the combination of controller 77 and control pendant 82) for setting at least one period of time for holding the upper leg support and the lower leg support at the angle corresponding to a limit, and means for holding the upper leg support and the lower leg support at the angle corresponding to a limit for the period of time set. Preferably, the intermediate limit is set as an intermediate extension limit, and a period of time is set for holding the upper leg support and the lower leg support at the intermediate extension limit and at the operational flexion limit. Preferably, this period of time for holding the upper and lower leg supports at both limits is five seconds.

Figure 6:
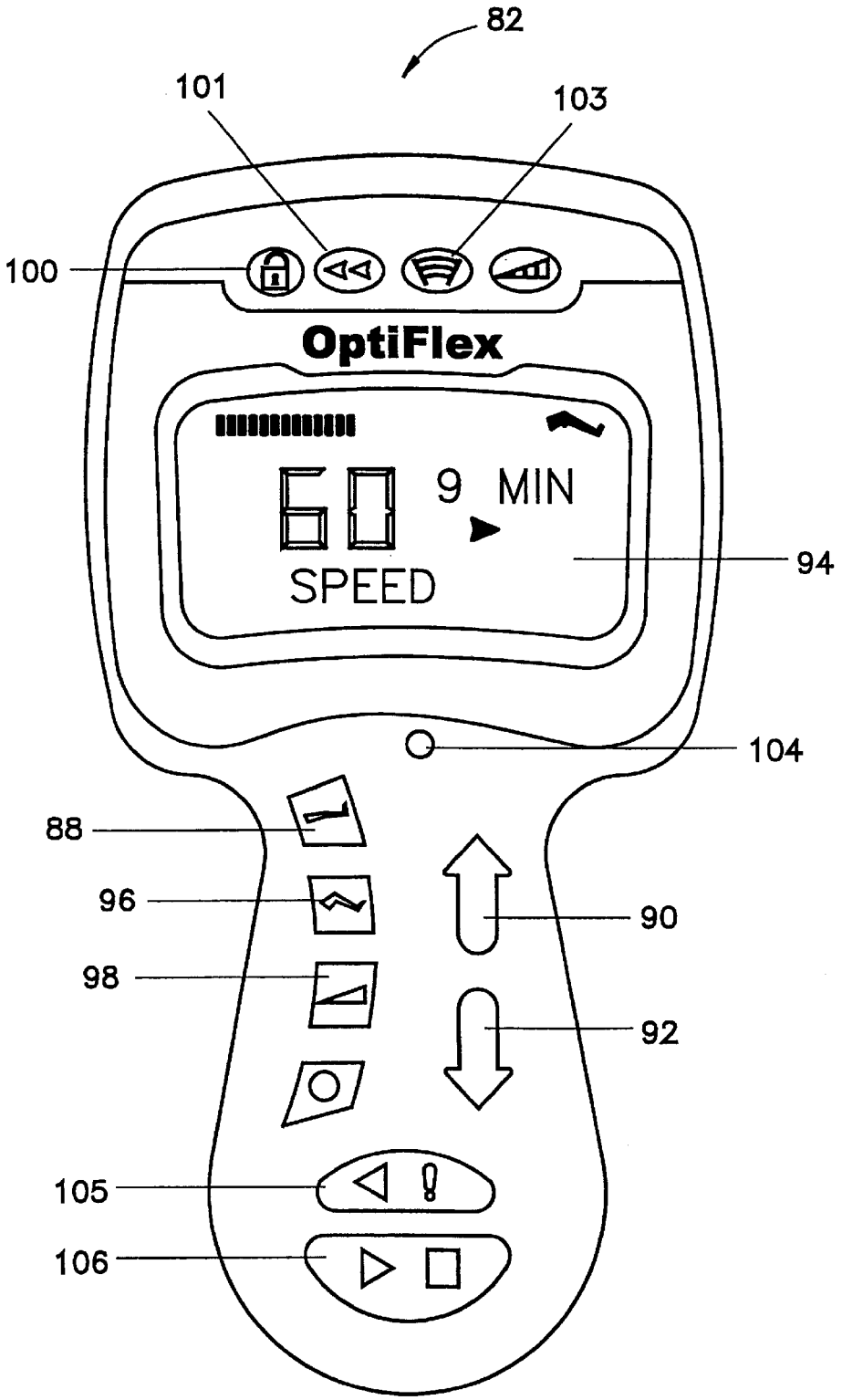
FIG. 6 is a front view of a control pendent that may be used in connection with the preferred embodiment of the invention.

In order to begin treatment using device 10, a power cord (not shown) is attached at power receptacle 84 (see FIG. 3) and connected to a common 110V electrical power circuit. On/Off switch 86 may then be then activated to energize the machine. Referring now to FIG. 6, the patient may set the extension limit of the operational range of motion by pressing Extension button 88 while pressing the Up button 90 or the Down button 92. Once the Extension button is pressed, the currently programmed extension limit (expressed as an extension angle) will appear on LCD display 94, along with an appropriate notation such as "Extension Angle". The display will also show the changes in the extension angle while both the Extension button 88 and either the Up or Down buttons are pressed. Once the desired extension limit for the operational range of motion is set, the operational flexion limit and the rate(s) or speed(s) of pivoting operation may be set by the same method using the Flexion button 96 along with the Up and Down buttons, and the Speed button 98 and the Up and Down buttons.

The Oscillation Zone feature of the invention may then be activated by pressing both the Mode button 100 and the Oscillation Zone button 103. An icon will appear on LCD display 94 to confirm the active status of the oscillation zone feature. The display will also show the currently programmed flexion limit (expressed as a flexion angle, in degrees). In one embodiment of the invention, an alphanumeric prompt will appear on display 94 for the patient or therapist to set the intermediate extension limit. The user will then press Extension button 96, while simultaneously pressing Up button 90 or Down button 92 to establish the desired angle of the intermediate extension limit. The display will reflect these changes. As soon as the user presses Extension button 96, an alphanumeric prompt such as "Press Mode to Accept Final Intermediate Extension Angle" will appear. Once the desired angle is reached, as indicated by the display, the user may set the intermediate extension angle by pressing Mode button 100. If it is necessary at any time to clear the current setting, the Reset button 104 may be pressed. The same process may be repeated if it is desired to set an intermediate flexion angle. If it is not desired to set an intermediate flexion angle, the patient or therapist may simply press Mode button 100.

In the preferred embodiment, the user need only set the operational range of motion limits, the first speed or rate of pivoting operation, and activate the Oscillation Zone feature of the invention. In the preferred embodiment, upon the completion of these steps, the controller will establish a preferred default value for the intermediate extension limit which corresponds to an angle which is approximately 10° greater than the operational flexion angle. The patient or therapist need only press the Start/Stop button 106 to set the device 10 into motion, unless he desires to override the default settings, in which case he may set the limits in the same manner described above.

Once the proper settings have been set and the Oscillation Zone feature is activated, the motor 73 will drive the driver along the axis of the frame, back and forth in a substantially continuous fashion, so as to move the patient's leg through a plurality of cycles of motion, each of which imposes a range of motion on the patient's leg comprising a flexion phase and an extension phase. The direction of movement of the driver along the axis of the frame will reverse when the driver reaches a flexion limit or an extension limit. Preferably, the device will accommodate a flexion limit corresponding to a flexion angle $\theta_f$ of about 60° or greater, and an extension limit corresponding to an extension angle $\theta_e$ of about 190° or less. The invention also contemplates that display 94 may express any of the flexion and/or extension angles referred to herein as 180°–θ. In other words, a flexion angle $\theta_f$ of 60° may be expressed as 120° (180°–60°), and an extension angle $\theta_e$ of 190° may be expressed as −10° (180°–190°).

In a preferred embodiment of the invention, the means (comprised of the combination of controller 77 and control pendant 82) for setting the intermediate limit may be configured so as to set such limit only as an extension limit, consistent with the most common treatment regimen that is prescribed for knee rehabilitation. For other treatment regimens, however, it may be appropriate to configure the machine to set such limit only as a flexion limit. In each of those instances, it is preferred that the limits which define the Oscillation Zone have corresponding angles which differ by approximately 10°.

In a preferred embodiment, once the device is operating and the Oscillation Zone feature has been activated (and an intermediate extension limit established), the driver will begin moving along the axis of the frame from the programmed operational extension limit towards the operational flexion limit. At the operational flexion limit, the driver will reverse direction along the axis of the frame and move towards the intermediate extension limit. When the driver reaches the point along the axis which corresponds with the intermediate extension limit, the driver will reverse direction and move towards the operational flexion limit. Each time the driver moves from the operational flexion limit to the intermediate extension limit (or pivots the upper and lower leg supports from the operational flexion angle to the intermediate extension angle), the means (comprised of the combination of controller 77 and control pendant 82) for counting the number of times such motion occurs increases the count by one. Once the driver has moved from the operational flexion limit to the intermediate extension the set number of times (preferably three), the extension limit will move from the intermediate extension limit to the operational extension limit. Then, when the driver next reaches the operational flexion limit and changes direction, it will continue past the intermediate extension limit to the operational extension limit. Of course, the means (comprised of the combination of controller 77 and control pendant 82) for setting and counting the number of times the driver moves between the operational flexion limit and the intermediate extension limit may focus on the number of times the driver moves from the intermediate extension limit to the operational flexion limit (instead of on the number of times it moves from the operational flexion limit to the intermediate extension limit), or the number of times the driver changes direction while in the Oscillation Zone, and all such means are within the scope of the invention. As described herein, it is preferred that the driver move three consecutive times between the operational flexion limit and the intermediate extension limit, and then that it move one time between the operational flexion limit and the operational extension limit. Such motion will concentrate the treatment time that is spent in the Oscillation Zone, where rehabilitation benefits are most likely to occur.

The invention also contemplates that a means (comprised of the combination of controller 77 and control pendant 82) for setting and counting the number of times that the driver moves in a cycle between the operational flexion limit and the operational extension limit may be provided. In such embodiment of the invention, the driver may move through five consecutive sub-cycles (or any other number of sub-cycles) between the operational flexion limit and the intermediate extension limit, and then it may move through two cycles (or any other number of cycles) between the operational flexion limit and the operational extension limit.

In the preferred embodiment of the invention, an operational flexion limit, an operational extension limit and an intermediate extension limit may be set as described above. A number of times that the driver may be moved from the operational flexion limit to the intermediate extension limit before the extension limit is moved from the intermediate extension limit to the operational extension limit may also be set. The motor may then be activated so that the driver may be moved back and forth along the axis of the frame by operation of the motor. The driver will then move from the operational extension limit to the intermediate extension limit, where the Oscillation Zone begins. In step one of the sub-cycle of movement of the driver in the Oscillation Zone, the driver will move from the intermediate extension limit to the operational flexion limit. In step two, the direction of the driver will change at the operational flexion limit. In step three, the driver will move from the operational flexion limit to the intermediate extension limit. In step four, the direction of the driver will change at the intermediate extension limit. Steps one through four will then be repeated the set number of times. Then the driver will be moved from the intermediate extension limit to the operational flexion limit. The direction of the driver will change at the operational flexion limit, and the extension limit will be moved from the intermediate extension limit to the operational extension limit. The driver will then move from the operational flexion limit to the operational extension limit. Preferably, as described herein, the number of times that steps one through four are repeated is two. This provides three sub-cycles of movement of the driver in the Oscillation Zone for each complete cycle between the operational limits.

The preferred embodiment also provides means (comprised of the combination of controller 77 and control pendant 82) for setting a period of time for holding the driver at an extension limit, and means (comprised of the combination of controller 77 and control pendant 82) for setting a period of time for holding the driver at a flexion limit. Means (comprised of the combination of controller 77 and control pendant 82) may also be provided for holding the driver at such limits for the set periods of time. The driver may be held at the intermediate extension limit (or the operational extension limit) for the period of time set every time the driver moves from the operational flexion limit to the intermediate extension limit (or the operational extension limit). In addition, the driver may be held at the operational flexion limit for the period of time set every time the driver moves from an extension limit (either the intermediate limit or the operational limit) to the operational flexion limit. It is also contemplated that the driver may be held at some, but not all, of the limits. This holding of the driver at the flexion and extension limits simulates the type of rehabilitative therapy that is commonly employed by trained therapists or physicians. Good results may be obtained when the duration of the hold at a limit is about five seconds.

In the embodiment of the invention illustrated in the drawings, the duration of the time for holding the driver may be set by pressing and holding the Extension/Flexion Delay button 105 for at least two seconds. After Delay button 105 has been pressed for at least two seconds, LCD display 94 will display the setting for the first extension or flexion limit which has been set, and if no limit has been set by the patient or therapist, then the LCD display will display the setting for one of the default limits. Until Delay button 105 is pressed for more than two seconds, the patient or therapist may advance through each of the limits which have been set, or through the default limits by pressing the Delay button. Each time Delay button 105 is depressed for less than two seconds, the LCD display will display the current setting or value of a different limit until all of the settings have been displayed, at which point the first such limit will be displayed again. If it is desired to program a delay at the limit which is displayed on the LCD display, the patient or therapist may increase or decrease the duration of the delay by pressing the Up button 90 or Down button 92 to establish the desired hold or pause duration. This process may be repeated until all of the desired delays have been set. When all of the desired pause durations have been set, the patient or therapist will press and hold the Extension/Flexion Delay button 105 for at least two seconds. By pressing and holding the Extension/Flexion Delay button for two seconds, the control will return to normal operation, thereby allowing the patient or therapist to input or change any other data. If it is necessary at any time to clear the current setting, the Reset button 104 may be pressed.

Each time the driver reaches a limit at which a hold or pause has been set, the driver will remain at that limit for a length of time equal to the duration set for that pause. However, it is also possible for the preferred embodiment to be configured such that the driver may be set to pause only at the beginning or end of a cycle or sub-cycle. For example, the driver may be programmed to hold for a period of time at the operational flexion limit, but only at the end of the prescribed number of sub-cycles, and without holding at the operational flexion limit during any of the sub-cycles. The driver may also be programmed to hold for a set period of time at the operational extension angle. In such embodiment, the driver will not hold its position for a set period of time again until the driver reaches the operational flexion limit immediately after the driver has been moved between the operational flexion limit and the intermediate extension limit the set number of times.

The preferred embodiment of the invention also contemplates a "Soft Turns" feature by which sudden changes in speed and direction at the flexion and extension limits are avoided. According to this embodiment of the invention, control means (comprised of the combination of controller 77 and control pendant 82) are provided for decelerating the driver from the preset speed of motion at a predetermined rate as it approaches an extension limit (where the driver stops and changes direction) beginning at a predetermined distance along the axis from the extension limit. Control means (comprised of the combination of controller 77 and control pendant 82) are also provided for accelerating the driver from a stop at an extension limit to the preset speed of motion at a predetermined rate for a predetermined distance after the driver reverses direction upon reaching the extension limit. In addition, this embodiment of the invention includes control means (comprised of the combination of controller 77 and control pendant 82) for decelerating the driver from the preset speed of motion at a predetermined rate as it approaches a flexion limit (where the driver stops and changes direction) beginning at a predetermined distance along the axis from the flexion limit and control means (comprised of the combination of controller 77 and control pendant 82) for accelerating the driver from a stop at a flexion limit to the preset speed of motion at a predetermined rate for a predetermined distance after the driver reverses direction upon reaching the flexion limit. Preferably, the predetermined distance along the axis at which deceleration of the driver as it approaches an extension limit begins defines a point along the axis of the frame that establishes an angle between the upper leg support and the lower leg support that is approximately 1–2° less than the extension angle for such cycle or subcycle. Furthermore, it is also preferred that the predetermined distance along the axis during which the driver is accelerated after it reverses direction upon reaching an extension limit defines a point along the axis of the frame that establishes an angle between the upper leg support and the lower leg support that is approximately 1–2° less than the extension angle for such cycle, and the predetermined distance along the axis at which deceleration of the driver as it approaches a flexion limit begins defines a point along the axis of the frame that establishes an angle between the upper leg support and the lower leg support that is approximately 1–2° greater than the flexion angle for such cycle. Furthermore, it is also preferred that the predetermined distance along the axis during which the driver is accelerated after it reverses direction upon reaching a flexion limit defines a point along the axis of the frame that establishes an angle between the upper leg support and the lower leg support that is approximately 1–2° greater than the flexion angle for such cycle. Finally, it is also preferred that the rate of deceleration and acceleration be constant.

As an example of operation of the "Soft Turns" and Oscillation Zone features according to the preferred embodiment of the invention, an operational flexion limit may be set corresponding to a flexion angle of 80° and an operational extension limit may be set corresponding to an extension angle of 170°. An intermediate extension limit may be set (or assumed by default) corresponding to an angle of 90°. A speed of operation of the driver may be set at 60° per minute, and the points at which the Soft Turns acceleration and the Soft Turns deceleration begin and end may be set corresponding to angles between the upper and lower leg supports of 82° and 168°. When the driver is being pivoted in the oscillation zone between the operational flexion limit and the intermediate extension limit, an additional point at which the Soft Turns acceleration and the Soft Turns deceleration begins and ends may be set corresponding to an angle between the upper and lower leg supports of 88°. When the driver is set in motion, it will move along the axis of the machine during the flexion phase at a speed of 60° per minute until it reaches a point corresponding to a flexion angle of 90°, where it enters the Oscillation Zone. The driver will continue to operate at a speed of 60° per minute until it reaches a point corresponding to a flexion angle of 82°. At this point, the driver will decelerate from a speed of 60° per minute to zero at the flexion limit. Then it will accelerate as it moves from the flexion limit in the opposite direction. This acceleration will continue until the driver reaches a point corresponding to an extension angle of 82°, at which point the driver will be moving at the preset speed of 60° per minute. The driver will maintain this speed until it reaches a point corresponding to an extension angle of 88°, whereupon, the driver will decelerate from a speed of 60° per minute to zero at the intermediate extension limit (90°). Then it will accelerate as it moves from the intermediate extension limit in the opposite direction (towards the flexion limit). This acceleration will continue until the driver reaches a point corresponding to a flexion angle of 88°, at which point the driver will be moving at the preset speed of 60° per minute. The driver will continue to operate at a speed of 60° per minute until it reaches a point corresponding to a flexion angle of 82°. At this point, the driver will decelerate from a speed of 60° per minute to zero at the flexion limit (80°). Then it will accelerate as it moves from the flexion limit in the opposite direction. This acceleration will continue until the driver reaches a point corresponding to an extension angle of 82°, at which point the driver will be moving at the preset speed of 60° per minute. The driver will continue to move between the intermediate extension limit and the operational flexion limit in this manner for the set number of times. However, as it approaches the intermediate extension limit during the extension phase after the prescribed sub-cycles have been completed, the driver will move past the intermediate limit at the rate of 60° per minute towards the operational extension limit. It will maintain this speed until it reaches a point corresponding to an extension angle of 168°, whereupon the driver will decelerate from a speed of 60° per minute to zero at the extension limit (170°). The driver will then change directions and move towards the flexion limit, accelerating as it moves from the extension limit. This acceleration will continue until the driver reaches a point corresponding to a flexion angle of 168°, at which point the driver will be moving at a speed of 60° per minute.

It is also contemplated that the device may simultaneously employ the Oscillation Zone feature and a feature that speeds the carriage through a portion of the range of motion. This latter feature may be referred to as the Fast Back feature, and it may be activated by simultaneously pressing Mode button 100 and Fast Back button 101. The Fast Back feature operates by pivoting the upper and lower leg supports so as to flex and/or extend the patient's leg through the non-working portion of the range of motion at a higher rate or speed than through the working portion of the range of motion. The pivoting rate or speed that is applied through the non-working range of motion is referred to as the first rate, and the pivoting rate or speed that is applied through the working range of motion is referred to as the second rate. In this embodiment of the invention, it is preferred that the Oscillation Zone be coincident with the working range of motion.

The preferred embodiment of the invention, which incorporates the Fast Back feature, includes control means (comprised of the combination of controller 77 and control pendant 82) for setting a first and a second rate at which the driver will move along the axis to pivot the upper leg support and the lower leg support at the connection therebetween between flexion and extension limits. Preferably, the second rate is set at the lesser of 50% of the first rate or 75° per minute.

The Fast Back feature of the invention also includes means (comprised of the combination of controller 77 and control pendant 82) for changing the rate at which the driver moves along the axis of the frame to pivot the upper leg support and the lower leg support from the first rate to the second rate and from the second rate back to the first rate. In the preferred embodiment of the invention, the speed of the driver will change from the first rate to the second rate at one of the operational limits and from the second rate to the first rate at the intermediate limit. If the intermediate limit is set as an extension limit, the driver will move along the axis during the flexion phase at the second rate. Pivoting during flexion from the angle corresponding to the operational extension limit to the angle corresponding to the operational flexion limit will preferably proceed at the second rate. It is also preferred that pivoting will continue at the second rate during extension from the angle corresponding to the operational flexion limit to the angle corresponding to the intermediate extension limit. When the driver moves to the intermediate extension limit during extension, the rate will preferably change from the second rate to the first rate, whereupon, pivoting from the angle corresponding to the intermediate extension limit to the operational extension limit will proceed at such first rate.

Similarly, if the intermediate limit is set as a flexion limit, the driver will move along the axis during the extension phase at the second rate. Pivoting during extension from the angle corresponding to the operational flexion limit to the angle corresponding to the operational extension limit will therefore preferably proceed at the second rate. It is also preferred that pivoting will continue at the second rate during flexion from the angle corresponding to the operational extension limit to the angle corresponding to the intermediate flexion limit. When the driver moves to the intermediate flexion limit during flexion, its rate of motion will preferably change from the second rate to the first rate, whereupon, pivoting from the angle corresponding to the intermediate flexion limit to the operational flexion limit will proceed at such first rate.

In the preferred embodiment, once the device is operating and the Oscillation Zone and Fast Back features have been activated and a first rate, a second rate and an intermediate extension limit have been set, the driver will move along the axis of the frame at the second rate while in the Oscillation Zone and otherwise while moving towards the operational flexion limit, and will move at the first rate of operation when moving from the intermediate extension limit to the operational extension limit in the extension phase.

Once the Fast Back feature has been activated and the operational and intermediate range of motion limits have been set, an alphanumeric prompt will appear on the display 94 for the patient or therapist to set the first and second rates at which the driver will move through the working range of motion. This first rate may be set in the manner described above by using the Speed button 98 and the Up and Down buttons. The preferred default value for the second rate of pivoting operation is the lesser of fifty percent of the first rate of pivoting operation or 75° per minute. If a different second rate is desired, it may be set in the same manner as the first.

If the Fast Back and Oscillation Zone features are both activated, an operational extension limit, an operational flexion limit, an intermediate extension limit, a number of times that the driver may be moved from the operational flexion limit to the intermediate extension limit before the extension limit is moved from the intermediate extension limit to the operational extension limit, a first rate at which the driver will move along the axis and a second such rate will all be set. Then the motor may be activated so that the driver may be moved back and forth along the axis of the frame. The driver will then move at the first rate from the operational extension limit to the intermediate extension limit, whereupon the rate at which the driver moves along the axis will change from the first rate to the second rate. The first step of operation in the Oscillation Zone will then occur, as the driver moves at the second rate from the intermediate extension limit to the operational flexion limit. The second step of operation in the Oscillation Zone will occur at the operational flexion limit, where the direction of movement of the driver will change. In the third step, the driver will continue to move at the second rate from the operational flexion limit to the intermediate extension limit. The fourth step of operation in the Oscillation Zone will occur at the intermediate extension limit, where the direction of the driver will again change. Steps one through four will then be repeated the set number of times. The driver will then move at the second rate from the intermediate extension limit to the operational flexion limit, whereupon, the direction of the driver will be changed, and the extension limit will be moved from the intermediate extension limit to the operational extension limit. The driver will then move at the second rate from the operational flexion limit to the intermediate extension limit. At the intermediate extension limit, the rate at which the driver moves along the axis will be changed from the second rate to the first rate, and the driver will move at the first rate from the intermediate extension limit to the operational extension limit.

The therapeutic device may also include a storage means 108 capable of storing data about one or more different patients including the extension and flexion limits used during a treatment session for each of the patients. The invention may also include a retrieval means by which the data in the storage means can be accessed at a later time.

Once the control and data storage features of the invention are appreciated, the control controller 77 and data storage means 108 required for operating device 10 may be programmed by those having ordinary skill in the art to which the invention relates.

As can be seen from the description herein, the invention provides for the establishment of a range of motion within which it is desired that the patient's knee be flexed and his leg extended a predetermined number of times per cycle, so as to concentrate the amount of time spent in the working portion of the range of motion and to provide a treatment regimen which replicates that which a patient might receive through physical therapy conducted by a therapist or a physician. Another advantage of a preferred embodiment of the invention is the establishment of operational and intermediate limits to the range of motion through which it is desired that the patient's knee be flexed and his leg extended, whereby the rate of operation may be adjusted one or more times per cycle so that the device operates at a first rate in the non-working or non-critical range of motion which enables the carriage to return to the working range of motion more frequently than conventional one speed CPM machines, thereby increasing the amount of time the patient's knee spends in the working range of motion, and at a second rate which is more conducive to rehabilitation in the working or critical range of motion. Another advantage of a preferred embodiment of the invention is its Soft Turns capability, wherein the carriage holding the patient's leg is decelerated, at a controlled rate over a controlled distance, from the operational speed to zero, as the carriage approaches the extension or flexion limit, and wherein the carriage is accelerated in the same fashion as the carriage moves away from the extension or flexion limit.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A therapeutic device for use in providing physical therapy for a patient's knee, which device comprises:

(a) an elongated frame having an axis;

(b) a lower leg support having a first end and a second end and being adapted to support the lower leg of the patient;

(c) an upper leg support having a first end and a second end and being adapted to support the upper leg of the patient;

wherein the first end of the upper leg support is pivotally connected to the first end of the lower leg support so that said upper leg support and said lower leg support pivots with respect to each other through a plurality of pivotal positions, each of which establishes an angle between said upper leg support and said lower leg support; and wherein said frame, lower leg support and upper leg support are interconnected in a manner such that both the tibia and the femur of the patient are generally coplanar with the axis of the frame;

said therapeutic device further including:

(d) means for repeatedly pivoting the lower leg support and the upper leg support at the connection therebetween so as to move the patient's leg through a plurality of cycles of motion, each of which:

(1) imposes a range of motion on the patient's leg comprising a flexion phase, in which the angles of the pivotal positions between the lower leg support and the upper leg support are decreasing, and an extension phase, in which the angles of the pivotal positions between the lower leg support and the upper leg support are increasing;

(2) is defined by a flexion limit which establishes the minimum angle between the lower leg support and the upper leg support to which the lower leg support and the upper leg support are pivoted during a flexion phase and an extension limit which establishes the maximum angle between the lower leg support and the upper leg support to which the lower leg support and the upper leg support are pivoted during an extension phase;

(e) means for setting a desired range of motion including:

(1) an operational extension limit which corresponds to an operational extension angle between the upper leg support and the lower leg support to which the upper and lower leg supports are pivoted during the extension phase of a cycle; and (2) an operational flexion limit which corresponds to an operational flexion angle between the upper leg support and the lower leg support to which the upper and lower leg supports are pivoted during the flexion phase of a cycle;

(f) means for setting at least one intermediate limit within the desired range of motion, which intermediate limit corresponds to an oscillation zone angle between the upper leg support and the lower leg support, wherein each such intermediate limit is set:

(1) as an extension limit which will correspond to an oscillation zone extension angle which is less than the operational extension angle; or (2) as a flexion limit which will correspond to an oscillation zone flexion angle which is greater than the operational flexion angle;

(g) means for moving:
(1) the extension limit from the operational extension limit to the intermediate extension limit; and
(2) the extension limit from the intermediate extension limit to the operational extension limit;
if the intermediate limit is set as an extension limit; or
(3) the flexion limit from the operational flexion limit to the intermediate flexion limit; and
(4) the flexion limit from the intermediate flexion limit to the operational flexion limit;
if the intermediate limit is set as a flexion limit;

(h) means for setting:
(1) a number of times that the upper leg support and the lower leg support are pivoted from the operational extension angle to the intermediate flexion angle before the flexion limit is moved from the intermediate flexion limit to the operational flexion limit, if the intermediate limit is set as a flexion limit; or
(2) a number of times that the upper leg support and the lower leg support are pivoted from the operational flexion angle to the intermediate extension angle before the extension limit is moved from the intermediate extension limit to the operational extension limit, if the intermediate limit is set as an extension limit; and (i) means for counting:
(1) the number of times that the upper leg support and the lower leg support are pivoted from the operational extension angle to the intermediate flexion angle if the intermediate limit is set as a flexion limit; or
(2) the number of times the upper leg support and the lower leg support are pivoted from the operational flexion angle to the intermediate extension angle if the intermediate limit is set as an extension limit.

2. The device of claim 1 wherein the length of the lower leg support is adjustable.

3. The device of claim 1 wherein:
(a) three is set as the number of times that the upper leg support and the lower leg support are pivoted from the operational extension angle to the intermediate flexion angle before the flexion limit is moved from the intermediate flexion limit to the operational flexion limit, if the intermediate limit is set as a flexion limit; or
(b) three is set as the number of times that the upper leg support and the lower leg support are pivoted from the operational flexion angle to the intermediate extension angle before the extension limit is moved from the intermediate extension limit to the operational extension limit, if the intermediate limit is set as an extension limit.

4. The device of claim 1 which includes:
(a) means for setting at least one period of time for holding the upper leg support and the lower leg support at the angle corresponding to a limit;
(b) means for holding the upper leg support and the lower leg support at the angle corresponding to a limit for the period of time set.

5. The device of claim 1 which includes:
(a) means for setting a first rate at which the lower leg support and the upper leg support are pivoted at the connection therebetween;
(b) means for setting a second rate at which the lower leg support and the upper leg support are pivoted at the connection therebetween;
(c) means for changing the rate at which the lower leg support and the upper leg support are pivoted at the connection therebetween from the first rate to the second rate:
(1) at the operational extension limit if the intermediate limit is set as an extension limit; or
(2) at the operational flexion limit if the intermediate limit is set as a flexion limit; and
(d) means for changing the rate at which the lower leg support and the upper leg support are pivoted at the connection therebetween from the second rate to the first rate at the intermediate limit:
(1) during the extension phase if the intermediate limit is set as an extension limit; or
(2) during the flexion phase if the intermediate limit is set as a flexion limit.

6. The device of claim 5 wherein the second rate is set at the lesser of 50% of the first rate or 75° per minute.

7. The device of claim 1:
(a) wherein the upper leg support includes:
(1) an upper portion; and
(2) a third support having a first end and a second end, the first end being pivotally attached to the frame and the second end being pivotally attached to the lower leg support; and
(3) a linkage having a first end and a second end, the first end being pivotally attached to the upper portion and the second end being pivotally attached to the third support;
(b) wherein the means for repeatedly pivoting the lower leg support and the upper leg support at the connection therebetween includes:
(1) a motor;
(2) a driver that is adapted to move in both directions along the axis of the frame; and
(3) a drive means that is adapted to interconnect the motor and the driver so that operation of the motor will move the driver along the axis of the frame;
(c) wherein the second end of the lower leg support is attached to the driver;
wherein the upper let support, the lower leg support, the third support and the linkage are arranged and interconnected so that the upper leg support pivots about a virtual pivot axis which is proximate to the patient's hip joint; and
wherein because of the interconnection of said supports and the linkage, and the connection of the lower leg support to the driver, movement of the driver in one direction along the axis will cause extension and movement of the driver in the opposite direction along the axis will cause flexion;
(d) which device includes:
(1) a foot support which is mounted to the lower leg support at its second end;
(2) means for setting a desired range of motion including an operational extension limit which corresponds to a point along the axis of the frame to which the driver is moved during the extension phase by operation of the motor to establish an operational extension angle between the upper leg support and the lower leg support, and an operational flexion limit which corresponds to a point along the axis of the frame to which the driver is moved by operation of the motor during the flexion phase to establish an operational flexion angle between the upper leg support and the lower leg support;
(3) means for setting at least one intermediate limit to the range of motion, which limit corresponds to a point along the axis of the frame to which the driver is moved by operation of the motor to establish an oscillation zone angle between the upper leg support and the lower leg support, wherein each such intermediate limit is set:

(i) as an oscillation zone extension limit corresponding to a point along the axis of the frame which establishes an oscillation zone extension angle which is less than the operational extension angle; or (ii) as an oscillation zone flexion limit corresponding to a point along the axis of the frame which establishes an oscillation zone flexion angle which is greater than the operational flexion angle;

(4) means for activating the motor to drive the driver along the axis of the frame;

(5) means for reversing the direction of movement of the driver along the axis of the frame during a flexion phase when the driver reaches a flexion limit; and (6) means for reversing the direction of movement of the driver along the axis of the frame during an extension phase when the driver reaches an extension limit.

8. The device of claim 7 wherein the length of the third support is adjustable.

9. The device of claim 7 wherein the foot support is pivotally mounted at the second end of the lower leg support.

10. The device of claim 7 which includes a storage means capable of storing data about one or more different patients including the extension and flexion limits used during a treatment session for each of the patients accessed at a later time and reviewed as a part of a patient's physical therapy.

11. The device of claim 7 wherein:

(a) the drive means includes an externally threaded drive rod which is mounted in the frame and disposed along the axis of the frame, which drive rod is adapted to be turned by the motor; and (b) the driver includes an internally threaded nut that is adapted to mate with the drive rod, which nut is mounted on the drive rod in threaded engagement therewith, so that the driver moves along the axis of the frame as the drive rod is turned by the motor.

12. The device of claim 7 wherein the intermediate limit corresponds to a point along the axis of the frame to which the driver is moved by operation of the motor to establish:

(a) an oscillation zone extension angle which is approximately 10° greater than the operational flexion limit, if the intermediate limit is set as an extension limit; or (b) an oscillation zone flexion angle which is approximately 10° less than the operational extension limit, if the intermediate limit is set as a flexion limit.

13. The device of claim 7 which includes:

(a) means for setting a first rate at which the driver will move along the axis to pivot the upper leg support and the lower leg support;

(b) means for setting a second rate at which the driver will move along the axis to pivot the upper leg support and the lower leg support;

(c) means for changing the rate at which the driver moves along the axis from the first rate to the second rate at the intermediate limit:

(1) during the flexion phase if the intermediate limit is set as an extension limit; or (2) during the extension phase if the intermediate limit is set as a flexion limit;

(d) means for changing the rate at which the driver moves along the axis from the second rate to the first rate:

(1) at the operational flexion limit if the intermediate limit is set as an extension limit; or (2) at the operational extension limit if the intermediate limit is set as a flexion limit.

14. The device of claim 7 which includes:

(a) means for decelerating the driver at a predetermined rate as it approaches an extension limit beginning at a point located a predetermined distance along the axis from the extension limit;

(b) means for accelerating the driver at a predetermined rate for a predetermined distance after it reverses direction upon reaching an extension limit;

(c) means for decelerating the driver at a predetermined rate as it approaches a flexion limit beginning at a predetermined distance along the axis from the flexion limit; and (d) means for accelerating the driver at a predetermined rate for a predetermined distance after it reverses direction upon reaching a flexion limit.

15. The device of claim 14 wherein:

(a) the point located a predetermined distance along the axis of the frame from the extension limit at which deceleration of the driver begins as the driver approaches an extension limit establishes an angle between the upper leg support and the lower leg support that is approximately 1–2° less than the angle of the extension limit for such cycle;

(b) the predetermined distance along the axis during which the driver is accelerated after it reverses direction upon reaching an extension limit defines a point along the axis of the frame that establishes an angle between the upper leg support and the lower leg support that is approximately 1–2° less than the angle of the extension limit for such cycle;

(c) the point located a predetermined distance along the axis of the frame from the flexion limit at which deceleration of the driver begins as the driver approaches a flexion limit establishes an angle between the upper leg support and the lower leg support that is approximately 1–2° greater than the angle of the flexion limit for such cycle; and (d) the predetermined distance along the axis during which the driver is accelerated after it reverses direction upon reaching a flexion limit defines a point along the axis of the frame that establishes an angle between the upper leg support and the lower leg support that is approximately 1–2° greater than the angle of the flexion limit for such cycle.

16. A method of providing physical therapy for a patient's knee by moving the patient's leg through a plurality of cycles of motion in which the patient's upper leg is pivoted with respect to the patient's lower leg at the knee, wherein each cycle imposes a range of motion on the patient's leg comprising a flexion phase in which the angle between the femur of the patient's upper leg and the tibia of the patient's lower leg is decreasing and an extension phase in which the angle between the femur of the patient's upper leg and the tibia of the patient's lower leg is increasing, and wherein each cycle of motion is defined by a flexion limit which establishes the minimum angle between the femur of the patient's upper leg and the tibia of the patient's lower leg to which the patient's leg is pivoted during a flexion phase and an extension limit which establishes the maximum angle between the femur of the patient's upper leg and the tibia of the patient's lower leg to which the patient's leg is pivoted during an extension phase, which method comprises the steps of:

(a) providing a therapeutic device that is adapted to receive the upper leg and the lower leg of the patient, said device comprising:

(1) an elongated frame having an axis;

(2) a motor;

(3) a driver that is adapted to move in both directions along the axis of the frame;

(4) a drive means that is adapted to interconnect the motor and the driver so that operation of the motor will move the driver along the axis of the frame;

(5) a lower leg support having a first end and a second end and being adapted to support the lower leg of the patient, wherein the second end of the lower leg support is attached to the driver;

(6) an upper leg support having a first end and a second end and being adapted to support the upper leg of the patient, wherein the first end of the upper leg support is pivotally connected to the first end of the lower leg support, and wherein the upper leg support includes:

(i) an upper portion; and (ii) a third support having a first end and a second end, the first end being pivotally attached to the frame and the second end being pivotally attached to the lower leg support; and (iii) a linkage having a first end and a second end, the first end being pivotally attached to the upper portion and the second end being pivotally attached to the third support;

wherein the upper leg support, the lower leg support, the third support and the linkage are arranged and interconnected so that the upper leg support pivots about a virtual pivot axis which is proximate to the patient's hip joint; and wherein because of the interconnection of said supports and the linkage, and the connection of the lower leg support to the driver, movement of the driver in one direction along the axis comprises an extension phase and movement of the driver in the opposite direction along the axis comprises a flexion phase, so that movement of the driver along the axis of the frame will cause said upper leg support and said lower leg support to be pivoted with respect to each other through a plurality of pivotal positions, each of which establishes an angle between said upper leg support and said lower leg support corresponding to an angle between the femur of the patient's upper leg and the tibia of the patient's lower leg;

(7) a foot support which is mounted to the lower leg support at its second end;

(8) means for setting a desired range of motion including an operational extension limit which corresponds to a point along the axis of the frame to which the driver is moved during the extension phase of a cycle by operation of the motor to establish an operational extension angle between the upper leg support and the lower leg support, and an operational flexion limit which corresponds to a point along the axis of the frame to which the driver is moved by operation of the motor during the flexion phase of a cycle to establish an operational flexion angle between the upper leg support and the lower leg support;

(9) means for setting an intermediate extension limit within the desired range of motion, which intermediate extension limit corresponds to a point along the axis of the frame to which the driver is moved by operation of the motor to establish an oscillation zone extension angle between the upper leg support and the lower leg support that is less than the operational extension angle;

(10) means for moving:

(A) the extension limit from the operational extension limit to the intermediate extension limit; and (B) the extension limit from the intermediate extension limit to the operational extension limit;

(11) means for setting a number of times that the driver is moved from the operational flexion limit to the intermediate extension limit before the extension limit is moved from the intermediate extension limit to the operational extension limit;

(12) means for counting the number of times that the driver is moved from the operational flexion limit to the intermediate extension limit;

(13) means for activating the motor to drive the driver along the axis of the frame;

(14) means for reversing the direction of movement of the driver along the axis of the frame during a flexion phase when the driver reaches a flexion limit;

(15) means for reversing the direction of movement of the driver along the axis of the frame during an extension phase when the driver reaches an extension limit;

(b) setting an operational flexion limit;

(c) setting an operational extension limit;

(d) setting an intermediate extension limit;

(e) setting a number of times that the driver may be moved from the operational flexion limit to the intermediate extension limit before the extension limit is moved from the intermediate extension limit to the operational extension limit;

(f) activating the motor so that the driver is moved back and forth along the axis of the frame by operation of the motor;

(g) moving the driver from the operational extension limit to the intermediate extension limit;

(h) moving the driver from the intermediate extension limit to the operational flexion limit;

(i) changing direction of the driver at the operational flexion limit;

(j) moving the driver from the operational flexion limit to the intermediate extension limit;

(k) changing direction of the driver at the intermediate extension limit;

(l) repeating steps (h) through (k) the set number of times;

(m) moving the driver from the intermediate extension limit to the operational flexion limit;

(n) changing direction of the driver at the operational flexion limit;

(o) moving the extension limit from the intermediate extension limit to the operational extension limit;

(p) moving the driver from the operational flexion limit to the operational extension limit.

17. The method of claim 16 which includes setting two as the number of times that steps (h) through (k) are repeated.

18. The method of claim 16 which includes:

(a) providing a therapeutic device which includes:

(1) means for setting a first rate at which the driver will move along the axis to pivot the upper leg support and the lower leg support;

(2) means for setting a second rate at which the driver will move along the axis to pivot the upper leg support and the lower leg support;

(3) means for changing the rate at which the driver moves along the axis during the flexion phase from the first rate to the second rate at the intermediate extension limit; and (4) means for changing the rate at which the driver moves along the axis during the extension phase from the second rate to the first rate at the intermediate extension limit;

(b) setting a first rate at which the driver will move along the axis to pivot the upper leg support and the lower leg support;

(c) setting a second rate at which the driver will move along the axis to pivot the upper leg support and the lower leg support;

(d) activating the motor so that the driver will move back and forth along the axis of the frame by operation of the motor;

(e) moving the driver at the first rate from the operational extension limit to the intermediate extension limit;

(f) changing the rate at which the driver moves along the axis from the first rate to the second rate;

(g) moving the driver at the second rate from the intermediate extension limit to the operational flexion limit;

(h) changing direction of the driver at the operational flexion limit;

(i) moving the driver at the second rate from the operational flexion limit to the intermediate extension limit;

(j) changing direction of the driver at the intermediate extension limit;

(k) repeating steps (g) through (j) the set number of times;

(l) moving the driver at the second rate from the intermediate extension limit to the operational flexion limit;

(m) changing direction of the driver at the operational flexion limit;

(n) moving the extension limit from the intermediate extension limit to the operational extension limit;

(o) moving the driver at the second rate from the operational flexion limit to the intermediate extension limit;

(p) changing the rate at which the driver moves along the axis from the second rate to the first rate at the intermediate extension limit;

(q) moving the driver at the first rate from the intermediate extension limit to the operational extension limit.

19. The method of claim 16 which includes:

(a) providing a therapeutic device which includes:

(20) means for setting a period of time for holding the driver at the intermediate extension limit;

(21) means for holding the driver at the intermediate extension limit for the period of time set;

(22) means for setting a period of time for holding the driver at the operational flexion limit;

(23) means for holding the driver at the operational flexion limit for the period of time set;

(r) setting a period of time for holding the driver at the intermediate extension limit;

(s) setting a period of time for holding the driver at the operational flexion limit;

(t) holding the driver at the intermediate extension limit for the period of time set when the driver moves from the operational flexion limit to the intermediate extension limit;

(u) holding the driver at the operational flexion limit for the period of time set when the driver moves from an extension limit to the operational flexion limit.

20. The method of claim 19, which includes:

(v) setting five seconds as the period of time for holding the driver at the intermediate extension limit; and (w) setting five seconds as the period of time for holding the driver at the operational flexion limit.

* * * * *

UNITED STATES PATENT AND TRADEMARK OFFICE

CERTIFICATE OF CORRECTION

PATENT NO. : 6,221,032 B1 
DATED : April 24, 2001
INVENTOR(S) : Frederick W. Blanchard, Stephan L. Brown, Dwayne Hofstatter, Chris Linville, Jeffrey K. Pohl, James R. Vetter, Jr.

It is certified that error appears in the above-identified patent and that said Letters Patent is hereby corrected as shown below:

Column 22,
Line 37, delete "let" and substitute therefor -- leg --.

Column 23,
Lines 30-31, delete "accessed at a later time and reviewed as a part of a patient's physical therapy".

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*